US006631839B2

(12) United States Patent
Shair

(10) Patent No.: US 6,631,839 B2
(45) Date of Patent: Oct. 14, 2003

(54) HOLDER FOR BUSINESS CARDS

(76) Inventor: Harold M. Shair, 41 Colby Ave., Rye, NY (US) 10580

( * ) Notice: Subject to any disclaimer, the term of this patent is extended or adjusted under 35 U.S.C. 154(b) by 34 days.

(21) Appl. No.: 09/844,994

(22) Filed: Apr. 30, 2001

(65) Prior Publication Data

US 2002/0158116 A1 Oct. 31, 2002

(51) Int. Cl.[7] ..... B65D 5/42

(52) U.S. Cl. ..... 229/141; 40/124.06; 206/37; 229/152; 229/164

(58) Field of Search ..... 229/103.3, 141, 229/152, 153, 164, 190, 193; 40/124, 124.06; 206/37, 39.5, 39.6, 449, 459.5, 555

(56) References Cited

U.S. PATENT DOCUMENTS 395,886 A * 1/1889 Emery ..... 229/152
1,384,115 A * 7/1921 Baxter ..... 229/152
2,181,482 A * 11/1939 Greve ..... 229/164
2,315,136 A * 3/1943 Platkin ..... 206/37
2,337,199 A * 12/1943 Holy ..... 229/190
2,459,218 A * 1/1949 Corey ..... 206/37
2,701,677 A * 2/1955 Grammer ..... 229/103.3
3,684,157 A * 8/1972 Mendez ..... 229/164
4,630,731 A * 12/1986 Albery ..... 206/555
4,645,077 A * 2/1987 McLaughlin et al. ..... 206/37
5,564,623 A * 10/1996 Kiley ..... 229/164

* cited by examiner

*Primary Examiner*—Gary E. Elkins
(74) *Attorney, Agent, or Firm*—David Peter Alan

(57) ABSTRACT

A cardboard holder for business cards, suitable for use on a bulletin board or a hard surface, is disclosed. The holder is made from a single piece of cardboard, folded to form a box of appropriate size to hold a number of business cards, displaying the cards so a prospective customer or client can take one. The device described is made from a pattern, cut and folded to form the card holder. Different embodiments of the invention allow the holder to be tacked onto a bulletin board using thumbtacks, affixed to a hard surface using an adhesive tape, or glued together and onto a surface with glue that is administered to the cardboard pattern during manufacturing. Additionally, the holder can be imprinted with the information contained on the cards it holds, to simulate the look of the cards.

16 Claims, 5 Drawing Sheets

HOLDER FOR BUSINESS CARDS

BACKGROUND OF THE INVENTION

Business cards are a popular and inexpensive method of promoting a business or professional practice today. However, a business owner, professional practitioner or employee of a business cannot always be available to personally give out cards to every prospective customer or client.

Various methods for displaying business cards have become widespread in recent years. Many food stores, other shops and restaurants have bulletin boards where business cards can be displayed. However, there is usually only room for a single card on the bulletin board, and the person who takes that card deprives others of the opportunity to see it. There is seldom room on a bulletin board for multiple cards for the same business. Handbills, with "tear-off tabs" at the bottom, allow a number of people to take the phone number of the business in question, but the tabs are small enough to be easily lost, there is little room on them to provide information, and a handbill with its tear-off tabs removed is esthetically undesirable.

The primary objective of the present invention is to provide a method for displaying a plurality of business cards, using little more space than is needed to display a single card. It is a further objective of the invention to allow people who view it to see the information normally contained on the card, even after all the cards have been removed from the holder described here. It is a further objective of the invention described to add versatility to business card display by allowing the holder described here to be used on a bulletin board, a cardboard backing surface, or a hard backing surface.

BRIEF DESCRIPTION OF THE INVENTION

The invention disclosed here is a business card holder, made from one piece of cardboard, typically the same type of cardboard used for business card stock. In the practice of the invention, the piece of cardboard is cut and folded into a boxlike structure, to accommodate business cards, typically of standard size, generally 2×3.5 inches (5×9 cm.). Other size cards can also be accommodated.

The front surface of the holder (facing the viewer of the cards inside and any information printed on the holder itself) is a rectangle whose width is slightly greater than the width of the cards to be held. Its height is less than the height of the cards to be held inside, so a person can easily take a card. A vertically oriented trapezoidal surface on each side of the front surface is folded to form the vertical walls of the holder. Surfaces adjacent to the trapezoidal surfaces and extending laterally from them form flaps, which are folded to overlap and form the back of the holder. These flaps are higher than the front surface. Extending below the front surface is a large area that will be folded into three smaller surfaces. The width of this large area is the same as the width of the front surface. A horizontally oriented rectangle, folded rearward (away from the viewer) along the bottom line of the front surface, forms the floor of the holder. A large rectangle, whose height exceeds the height of the cards to be displayed in the holder, forms the back of the holder. A fold along the rearward line of the floor surface allows the surface just described to form the back of the holder. Another fold at the top of the rear surface forms a flap extending downward from the top of the holder, toward the front (the direction toward the viewer of the cards inside and of the holder itself). This flap is tucked behind the front surface and, therefore, inside the holder.

The embodiment just described allows the holder to be mounted onto a bulletin board with thumbtacks. The flap mentioned above covers the thumbtacks for a more pleasing appearance. Rectangular side wall surfaces can be substituted for the trapezoidal side wall surfaces in the previous embodiment to permit the holder to be fixed onto a backing surface with an adhesive tape, such as "Scotch tape" or equivalent. Alternatively, glue can be administered to the two side flaps (which become part of the back of the holder) and the large surface which actually forms the rear surface of the holder, for adhesion to the surface to which the holder is to be attached.

An additional vertically oriented surface, located below each side wall surface of the holder, can be added. These surfaces can be folded to sit directly on top of the floor surface, or contacting and inside of the vertical wall surfaces, thus adding horizontal or vertical structural strength.

In the preferred embodiment of the invention, the holder is made of the same stock typically used for business cards. In that embodiment, the surfaces of the holder that face the viewer of the holder and the cards within it can be printed with the same information that is printed onto the cards intended for display. This allows any potential viewer to see information normally printed onto the cards, even if there are no cards in the holder at that time.

DETAILED DESCRIPTION OF THE INVENTION

The holder described here is made from an approximately T-shaped piece of stock, typically the same stock used for the cards to be placed there for display. While the preferred embodiment of the invention is a holder for business cards measuring approximately 2×3.5 inches (5×9 cm.), cards of other sizes and other items such as brochures can also be displayed in holders of various sizes.

Figure 1:
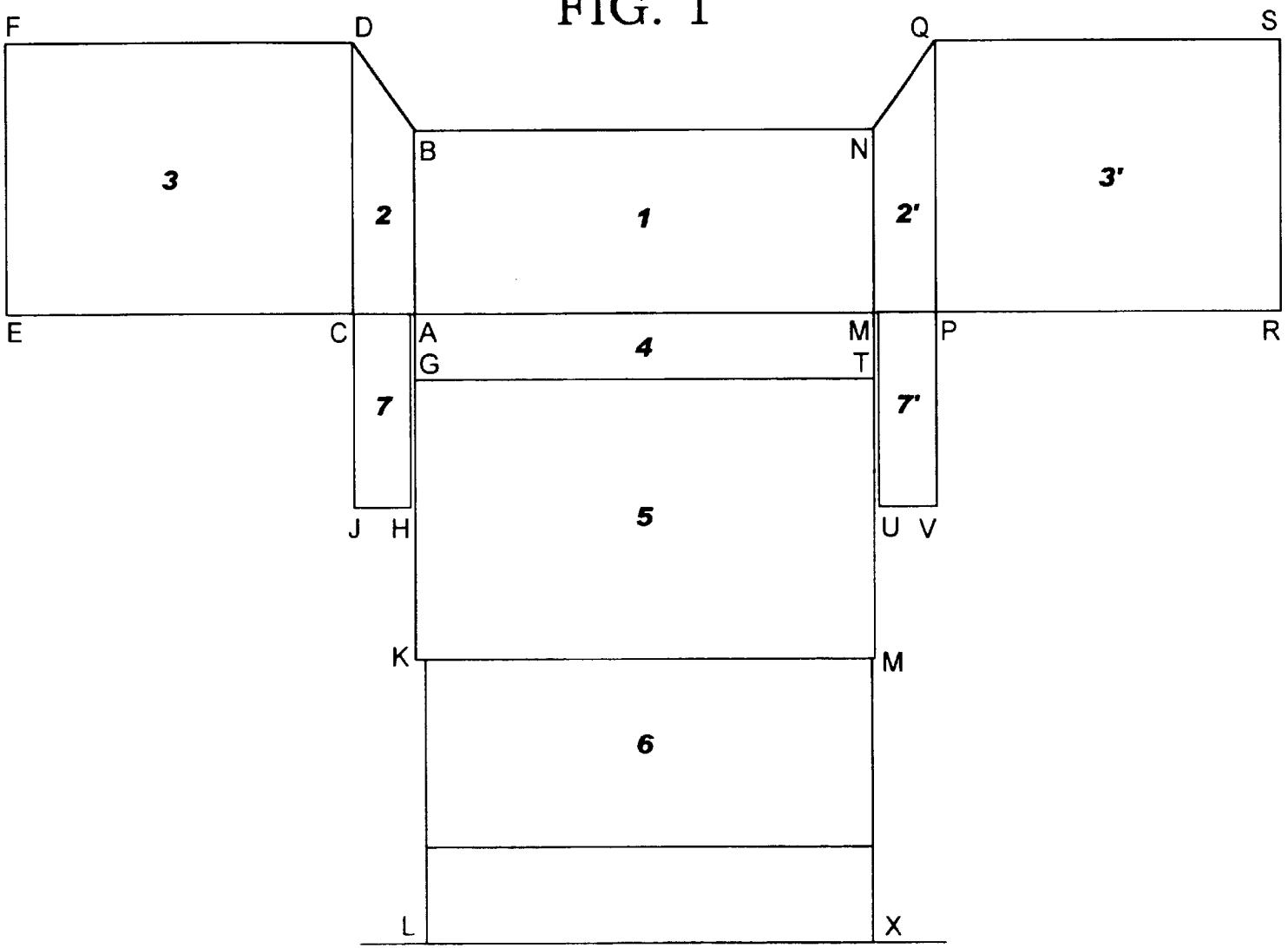
FIG. 1 shows an elevational view of the preferred embodiment of the invention, in an unfolded state.
Figure 1A:
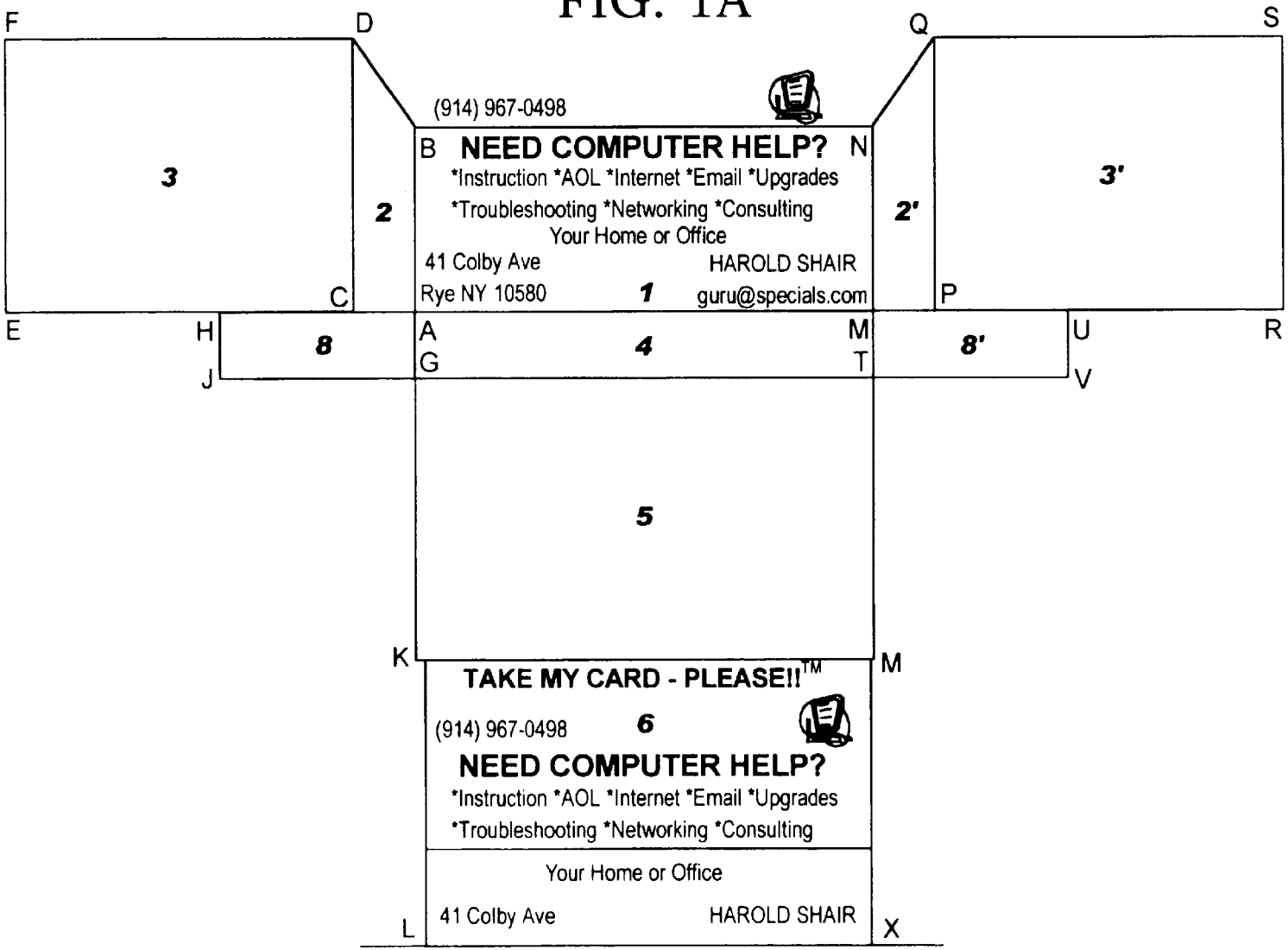
FIG. 1*a* shows an elevational view of an alternate embodiment of the invention, in an unfolded state with alternate strengthening flaps.

The drawings depict the preferred embodiment of the invention, a holder for business cards. The patterns depicted in FIG. 1 and la are unfolded. When folded, they will form the holder described herein. Although the pattern shown in FIGS. 1 and 1*a* are divided into ten surfaces for descriptive purposes, the pattern is a single piece of stock, which can be formed by die-cutting or any other method known in the art. In the preferred embodiment, it is to be punched out of a 8.5 inch×11 inch (or similar standard size) sheet of cardboard after printing.

Surface 1, measuring approximately 3.75 inches (9.5 cm.) wide and 1.5 inches (3.75 cm.) high, forms the front surface of the holder. Trapezoidal surfaces 2 and 2' form the side walls of the holder, while flaps 3 and 3', which measure approximately 2.25 inches (5.75 cm.) in height, are part of the rear structure of the holder after folding. Surfaces 4, 5 and 6 are the same width as front surface 1. Floor surface 4 is the same depth as the width of wall surfaces 2 and 2'. Rear surface 5, whose height is the same as that of rear flaps 3 and 3', contacts the surface upon which the holder is mounted. In the embodiment in FIGS. 1 and 1*a*, it is intended that the holder be tacked onto a bulletin board with thumbtacks. Flap 6, which has a height of approximately 1.5 inch (3 cm.) in the preferred embodiment, is folded to fit, inside the holder, to hide the thumbtacks, and to push the cards displayed therein toward the viewer of the holder and the cards so displayed. Flaps 7 and 7' (FIG. 1) or 8 and 8' (FIG. 1*a*), which are the same width as wall surfaces 2 and 2' and floor surface 4, act to strengthen the floor or walls, as shall be discussed.

In the practice of the invention, the pattern is folded to make the holder described. It should be noted that Flaps 7 and 7' (FIG. 1) are not contiguous with either floor surface 4 or rear surface 5, but only with wall surfaces 2 and 2'. Flaps 8 and 8' (FIG. 1*a*) are contiguous with floor surface 4 and not with wall surfaces 2 and 2' or 3 and 3'. Line segments AH and MU are not folding lines, but are actually cut before folding. For descriptive purposes, the side wall surface (2 and 2') and rear flaps (3 and 3') will be formed first, although they could also be formed last in the folding operation. The pattern is folded along lines BA and NM, until wall surfaces 2 and 2'are perpendicular to front surface 1 and extending behind front surface 1. Rear flaps 3 and 3' are then folded along lines CD and PQ, so that they are both parallel to front surface 1 and located behind it (away from the viewer who is a point of reference).

At this time, if you are constructing FIG. 1, flaps 7 and 7' extend below wall surfaces 2 and 2', while surfaces 4, 5 and 6 extend below front surface 1. Flaps 7 and 7' are then folded along lines AC and MP, such that line AC is contiguous with line AG, and line MP is contiguous with line MT. Flaps 7 and 7' are kept in that position to provide horizontal strengthening contiguous with floor surface 4. If you are constructing FIG. 1*a*, flaps 8 and 8' extend besides surface 4. Flaps 8 and 8' are folded to be contiguous with wall surfaces 2 and 2', thereby providing vertical strengthening. To simplify folding, flaps 7, 7', 8, and 8' may be omitted but with a reduction in strength.

Figure 2:
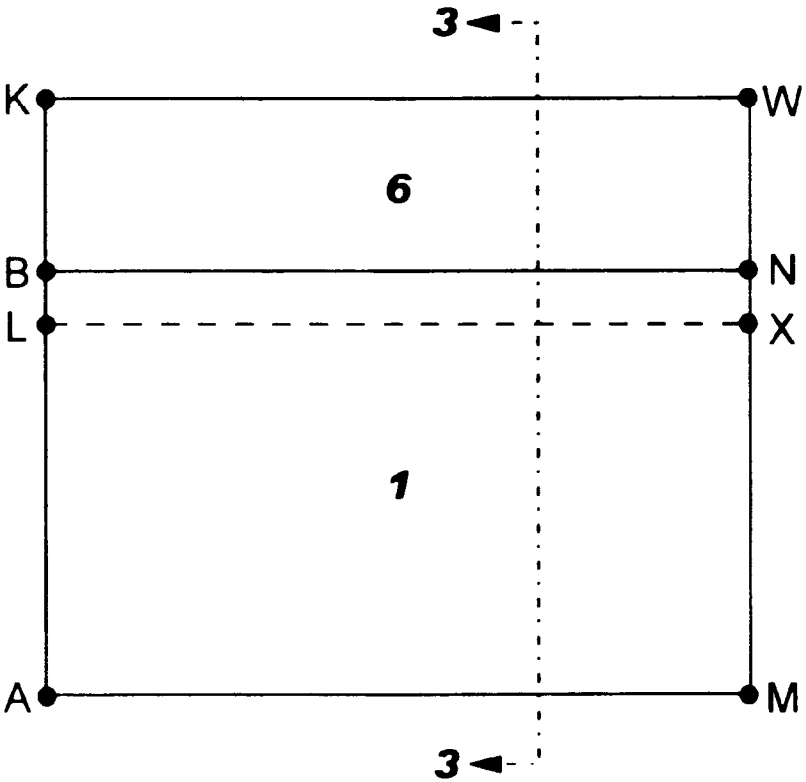
FIG. 2 is a view of the invention, folded for actual use, as seen by a viewer looking directly at the invention.

At this time, three folds are made in the area extending below front surface 1. A fold is made along line AM, with the area containing surfaces 4, 5 and 6 folded under front surface 1, to form a floor. Floor surface 4 should be the same width as wall surfaces 2 and 2'. A fold is then made along line GT, bringing rear surface 5 up and toward the front, to form the rear surface, along with rear flap surfaces 3 and 3'. The final fold is made along line KW, which is now positioned where a line connecting point D to point Q would be, if such a line represented an edge of a surface. Because the height of surface 6 exceeds the difference between the height of rear surface 5 and the height of front surface 1, flap 6 will extend below line BN. Flap 6 is then tucked into the holder, so its edge, line LX, extends below line BN and behind it, as seen by a person viewing the holder. FIG. 2 shows the holder, as folded and ready for use. Front surface 1 is visible, with line BN forming the top edge of that surface. Lines AB and MN form the left and right edges, and line AM forms the bottom edge. Flap 6 is seen above front surface 1, with line KW forming the top edge of the holder. The bottom of flap 6, line LX, extends below the top of front surface 1, as indicated by dotted line LX. In the practice of the invention, flap 6 is tucked inside the holder, behind front surface 1. Cards are then placed inside the holder, in front of flap 6 and behind front surface 1. In the preferred embodiment for practice of the invention, front surface 1 and flap 6 are imprinted with the same information that appears on the cards to be displayed there. This allows the information to be viewed, even after the last card has been removed. This information can be printed, embossed, or imparted to the holder by the same means used to impart the information to the cards, these means being known in the art. It should be noted that the alignment of printing should allow the holder to look like the cards intended to be displayed therein. Through careful positioning of the printing on the holder, the exact placement of the text (and artwork, if any) as it appears on the cards can be replicated.

Figure 3:
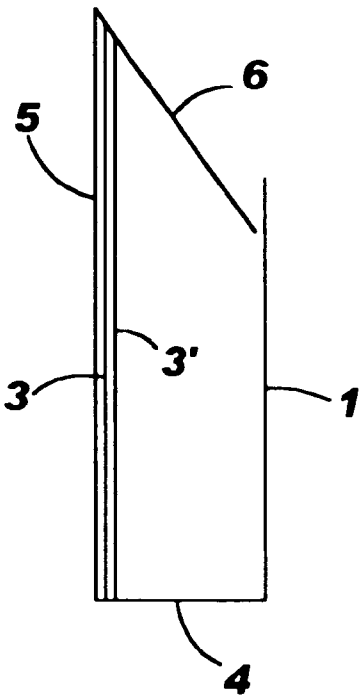
FIG. 3 is a cross-sectional view, along line 3—3 in FIG. 2.

FIG. 3 shows a cross-section of the holder in use, along the line 3—3 in FIG. 2. Note that flaps 3 and 3' form the inner layers of the back, and rear surface 5 forms the layer that adheres to the surface upon which the holder is placed. Surface 4 forms the floor of the holder, and surface 1 forms the front. Flap 6 is in back of front surface 1, and extends below it, on the inside of the holder. In the embodiment shown in FIGS. 1, 2 and 3, the holder is held onto a bulletin board (made of cork or a similar material) with thumbtacks. The tacks are not depicted, and any means for mounting the holder to the surface to which it is attached is equally valid in the practice of the invention.

Figure 4:
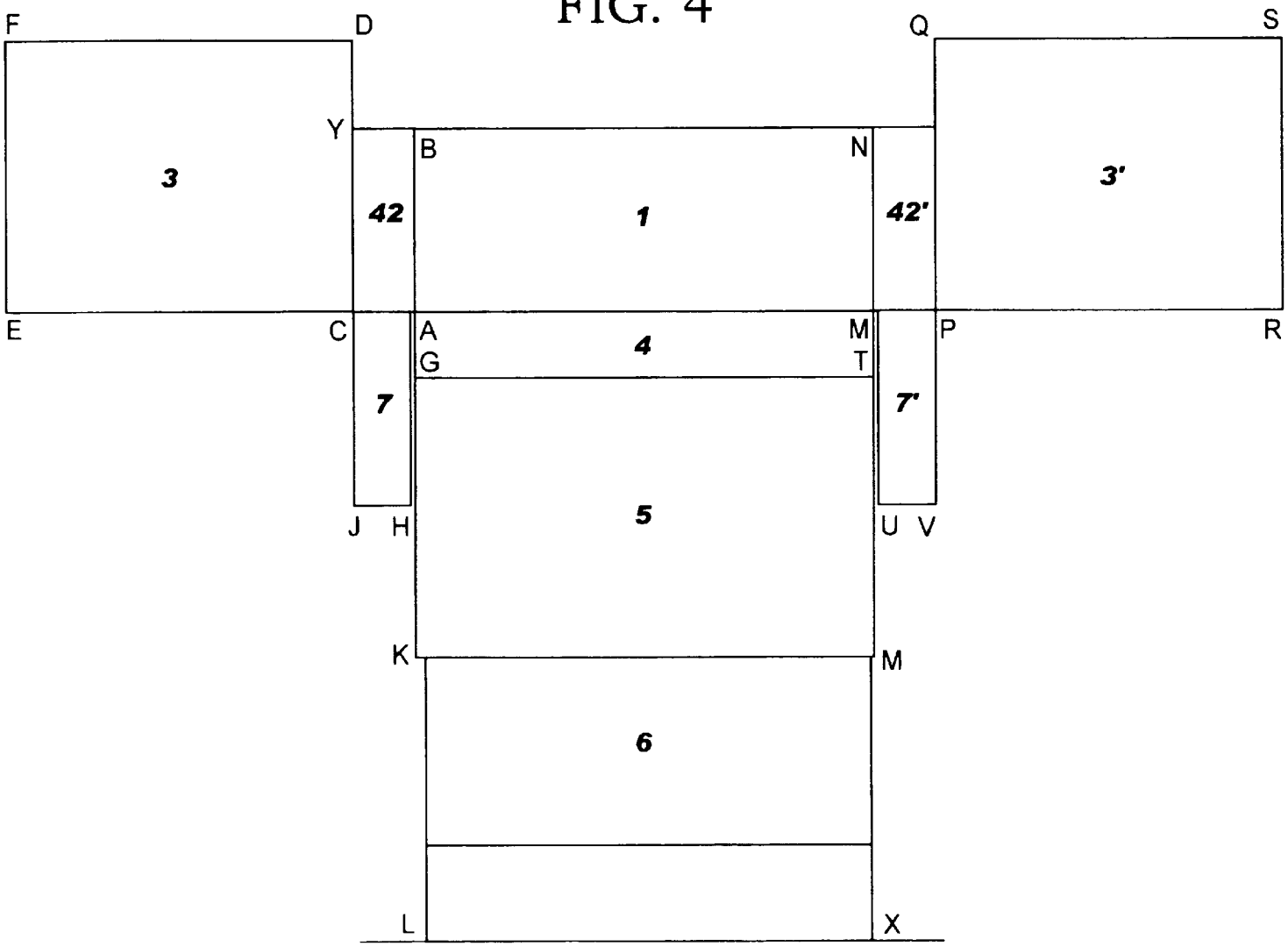
FIG. 4 is a view, similar to FIG. 1, of an alternate embodiment of the invention, modified to accommodate mounting to a backing surface by means of adhesive tape.
Figure 5:
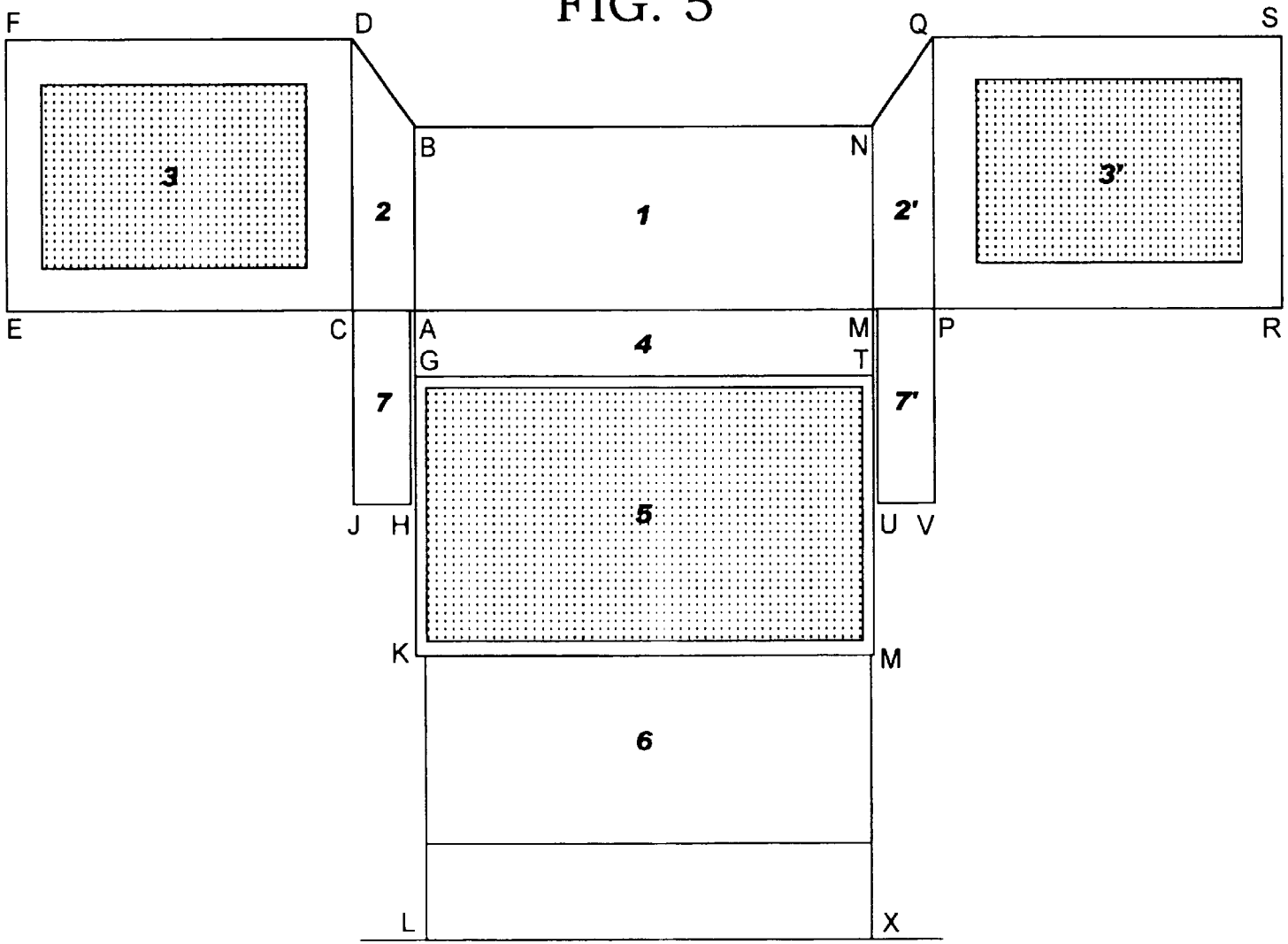
FIG. 5 is a view, similar to FIG. 1, of an alternate embodiment of the invention, modified to show the addition of glue on certain surfaces to facilitate the adhesion together of those surfaces to form the back of the invention, and to mount it to a backing surface.

FIG. 4 shows an alternate embodiment of the invention. The change is required to allow a strip of adhesive tape to be placed above the holder, above the top of front surface 1 and in front of back surface 5. The change in the geometry of the holder is that trapezoidal wall surfaces from FIG. 1 are replaced by rectangular wall surfaces 42 and 42'. The upper edges of wall surfaces 42 and 42' are represented by lines BY and NZ, which are lateral extensions of line BN, which forms the upper edge of front surface 1. Point Y is on line CD, and Point Z is on line PQ. All other surfaces and areas are the same as shown on FIG. 1. It should be noted that, in the practice of the invention, the length of segments DY and QZ (the amount by which rear surface 5 extends above front surface 1) should be three quarters of one inch or more. This is to accommodate the three-quarter-inch width of standard adhesive tape ("Scotch" tape or equivalent). FIG. 5 shows an alternative embodiment of the invention, featuring a different means for mounting it to the backing surface. In FIG. 5, the lined areas of surfaces 3, 3' and 5 indicate that glue has been applied to those surfaces during manufacture. Any glue that will bond paper or cardboard is acceptable. For example, the adhesive used on the "certified mail" stickers and "green cards" that serve as a return receipt as used by the U.S. Postal Service would be useful. Surfaces to which the glue was applied could have waxed paper or a similar non-stick paper applied that could be removed prior to folding. It does not matter how much of surfaces 3 and 3' are covered with glue, as long as sufficient surface area is covered to allow the surfaces to stick together solidly. Either the glued side of surface 3 will adhere to the nonglued side of surface 3' and the glued side of surface 3' will adhere to the nonglued side of rear surface 5, or the glued side of surface 3' will adhere to the nonglued side of surface 3 and the glued side of surface 3 will adhere to the nonglued side of rear surface 5. The order of folding surfaces 3 arid 3' is irrelevant, but they should be folded and glued into place before rear surface 5 is folded into place. In the preferred practice of this embodiment of the invention, the entire area (to contact backing) of rear surface 5 should be covered. This surface will adhere directly to the surface upon which the holder is to be mounted. The geometry of the holder in this embodiment is identical to that shown in FIG. 1. Only the addition of glue distinguishes it from that embodiment. The printing of the holder to replicate the look of the cards displayed therein is a useful feature of each of the embodiments of the invention. The different embodiments relate to the means for mounting the holder to the supporting surface.

FIG. 1*a* shows the invention with printing. On flap surface 6, the words "of text" below the phone number and graphic are actually hidden, and these words are visible on front surface 1. The printed material on flap 6 is visible in the practice of the invention, when no cards are stored therein. The phone number and graphic shown above line BN are depicted to show positioning of printed matter only. The area above line BN is not part of the unit depicted in FIG. 1*a*, but could be printed on the stock from which the unit is cut.

The embodiments described here should be thought of as illustrative and not limiting. Other embodiments are possible, especially with respect to size of holder and materials from which the holder can be made. Although the descriptions of the invention given here relate to a holder for business cards, the invention can be made in larger sizes for larger business cards, postcards, brochures, flyers and other paper or cardboard items. Items made of other materials can also be displayed. All of these potential embodiments should be considered as lying within the scope of the invention.

The invention claimed is:

1. A holder for displaying business cards or other articles, while permitting such articles to be taken therefrom, said holder being fixedly mounted to a supporting surface, and said holder being made from a single sheet of cardboard or other material that can be folded to assume a specific shape, and said single sheet being of a shape comprising:

(a): a first rectangle slightly wider than the articles to be displayed therein and of a height less than that of the articles to be displayed therein;

(b): two trapezoids extending laterally from said first rectangle, each of said trapezoids consisting of a second rectangle, smaller than said first rectangle, the width of said second rectangles being the same as the depth of the space inside said holder, and the height of each of said second rectangles being equal to the height of said first rectangle, combined with a right triangle, extending upwardly from each of the aforementioned second rectangles, the horizontal leg of each of said triangles being equal to and contiguous with the width of each of said second rectangles, and the vertical leg of each of said triangles being equal to the difference between the height of each of said second rectangles and an amount slightly exceeding the height of the articles to be displayed in the holder described herein;

(c): two third rectangles extending laterally from said trapezoids, each of said third rectangles having a width less than the width of the aforementioned first rectangle and a height equal to the length of the longest side of each of said trapezoids; and (d): a fourth rectangle extending below the aforementioned first rectangle, the width of which is the same as the width of the aforementioned first rectangle, and the height of said fourth rectangle being the sum of the width of each of the aforementioned trapezoids, the height of each of the aforementioned third rectangles and a distance which is less than the height of the aforementioned first rectangle and greater than the difference between the height of the aforementioned first rectangle and the height of the aforementioned third rectangles.

2. The holder according to claim 1, further comprising two fifth rectangles located below the trapezoids mentioned in claim 1 and contiguous only with said trapezoids, the width of said fifth rectangles being equal to the width of said trapezoids, and the height of said fifth rectangles being equal to or slightly less than the width of the aforementioned first rectangle.

3. The holder according to claim 1, which is formed by folding the sheet mentioned in claim 1 to place various component surfaces of said sheet into a boxlike configuration.

4. The holder according to claim 3, in which said first rectangle forms the front surface of said holder, said trapezoids from the side walls of said holder, said third rectangles overlap at the rear of said holder, and said fourth rectangle is folded three times to form the floor of said holder, the entire rear surface of said holder, and a flap extending from the upper edge of the rear surface of said holder, downwardly and frontwardly and, when tucked into said holder, its lower edge can come into contact with the front surface of said holder.

5. The holder according to claim 4, further comprising two additional fifth rectangles, said fifth rectangles being pivotally attached to said trapezoidal wall surfaces, and capable of being either vertically oriented and abutting said trapezoidal wall surfaces, or horizontally oriented and positioned on top of the floor of said holder.

6. The holder according to claim 4, further comprising rectangles located contiguously with said floor of said holder, and extending laterally therefrom, whose width is identical to the width of said floor, and whose length is less than the length of said wall surfaces;

such rectangles being capable of being either vertically oriented and abutting said wall surfaces or horizontally oriented and positioned on top of the floor of said holder.

7. The holder according to claim 1, further comprising information administered to said holder, said information substantially duplicating the information administered to the cards or other articles intended to be displayed therein.

8. The holder according to claim 1, in which the material from which said holder is made, is cardboard.

9. The holder according to claim 1, further comprising the addition of glue to certain portions of said sheet, specifically portions of one surface of each of the aforementioned third rectangles, and one surface of the portion of said fourth rectangle that forms the rear surface of said holder.

10. A holder for displaying business cards or other articles, while permitting such articles to be taken thereform, said holder being fixedly mounted to a supporting surface, and said holder being made from a single sheet of cardboard or other material that can be folded to assume a specific shape, and said single sheet being of a shape comprising:

(a): a first rectangle slightly wider than the articles to be displayed therein and of a height less than that of the articles to be displayed therein;

(b): two second rectangles extending laterally from said first rectangle, each of said second rectangles having a longer side of the same length as the height of said first rectangle and the longer sides of said second rectangles being contiguous with the lateral edges of said first rectangle, and each of said second rectangles also having a shorter side equal in length to the depth of the space inside the holder and said shorter sides extending laterally along the top and bottom edges of said first rectangle; and (c): two third rectangles extending laterally from said second rectangles, each of said third rectangles having a width less than the width of the aforementioned first rectangle and a height greater than the height of said first rectangle and also greater than the height of the articles to be displayed in said holder, the bottom edges of said third rectangles extending laterally from the bottom edges of said second rectangles, along the same line as the bottom edges of said second rectangles and said first rectangle;

(d): a fourth rectangle extending below the aforementioned first rectangle, the width of which is the same as the width of the aforementioned first rectangle, and the height of said fourth rectangle being the sum of the width of each of the aforementioned second rectangles, the height of each of the aforementioned third rectangles and a distance which is less than the height of the aforementioned first rectangle and greater than the distance between the height of the aforementioned first rectangle and the height of the aforementioned third rectangles.

11. The holder according to claim 10, further comprising fifth rectangles located below said second rectangles and contiguous only with said second rectangles, the width of said fifth rectangles being equal to the width of said second rectangles, and the height of said fifth rectangles being equal to or slightly less than the height of the said first rectangle.

12. The holder according to claim 10, which is formed by folding the sheet mentioned in claim 10 to place various component surfaces of said sheet into a boxlike configuration.

13. The holder according to claim 12, in which the aforementioned first rectangle forms the front surface of said holder, the aforementioned second rectangles form the side walls of said holder, the aforementioned third rectangles overlap at the rear of said holder, and the aforementioned fourth rectangle is folded three times to form the floor of said holder, the entire rear surface of said holder, and a flap extending from the upper edge of the rear surface of said holder, downwardly and frontwardly and, when tucked into said holder, its lower edge can come into contact with the front surface of said holder.

14. The holder according to claim 12, further comprising additional fifth rectangles, said fifth rectangles being pivotally attached to said second rectangles, and capable of being either vertically oriented and abutting said second rectangles, or horizontally oriented and positioned on top of the floor of said holder.

15. The holder according to claim 10, further comprising information administered to said holder, said information substantially duplicating the information administered to the cards of other articles intended to be displayed therein.

16. The holder according to claim 10, in which the material from which said holder is made, is cardboard.

* * * * *